United States Patent [19]

Eke

[11] Patent Number: 4,591,683

[45] Date of Patent: May 27, 1986

[54] MICROWAVE OVENS AND METHODS OF COOKING FOOD

[75] Inventor: Kenneth I. Eke, Sanderstead, England

[73] Assignee: Microwave Ovens Limited, Shirley, England

[21] Appl. No.: 702,597

[22] Filed: Feb. 19, 1985

Related U.S. Application Data

[63] Continuation-in-part of Ser. No. 513,296, Jul. 13, 1983, Pat. No. 4,508,947.

[51] Int. Cl.[4] ..... H05B 6/78

[52] U.S. Cl. ..... 219/10.55 B; 219/10.55 R; 219/10.55 F; 219/400; 126/21 A

[58] Field of Search ..... 219/10.55 B, 10.55 R, 219/10.55 E, 400, 10.55 F; 126/21 R, 21 A; 99/451, DIG. 14

[56] References Cited

U.S. PATENT DOCUMENTS

| | | | |
|---|---|---|---|
| 2,898,437 | 8/1959 | McFarland | 219/400 |
| 4,308,444 | 12/1981 | Takagi et al. | 219/10.55 B |
| 4,332,992 | 6/1982 | Larsen et al. | 219/10.55 R |
| 4,337,384 | 6/1982 | Tanaka et al. | 219/10.55 R X |
| 4,369,347 | 1/1983 | Shin | 219/10.55 R |
| 4,450,344 | 5/1984 | Sakoda et al. | 219/10.55 R X |
| 4,480,164 | 10/1984 | Dills | 219/10.55 R X |
| 4,481,396 | 11/1984 | Matsubayashi et al. | 219/10.55 B |
| 4,508,947 | 4/1985 | Eke | 219/10.55 B |

FOREIGN PATENT DOCUMENTS 1172918 12/1969 United Kingdom .

1332122 10/1973 United Kingdom .

*Primary Examiner*—Philip H. Leung

*Attorney, Agent, or Firm*—Penrose,Lucas & Albright

[57] ABSTRACT

A portable microwave oven is designed to be powered from a domestic power socket having a standard maximum power rating. The oven has two side walls, a base, a top wall, a rear wall and a closable front door together defining an oven cavity, a magnetron for supply microwave power to the cavity of the oven, a blower motor for generating a flow of cooling air for the magnetron, a rotatable turntable on the base of the cavity for supporting food thereon, a port in one of the side walls of the cavity, a vent in the rear wall of said vent leading to a vent outlet at the rear of the oven, a shutter mounted adjacent the port and movable between an open position in which the port is open and air is blown through the port and into the cavity by the blower motor and a closed position in which the port is closed by the shutter which prevents air delivered by the blower motor from reaching said cavity. Continuous microwave power is supplied to the cavity simultaneously with the supply of thermal power delivered by a fan forcing air over an electrical resistance heating element. The shutter is in the closed position when the electrical heating element is energized and in the open position to vent the cavity when the electrical heating element is de-energized, the blower motor being energized so long as the oven is switched on and a bypass duct being provided to direct at least some of the air delivered by the blower motor to a region adjacent the vent outlet to prevent condensation in this region.

10 Claims, 13 Drawing Figures

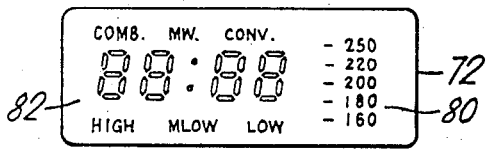
Fig. 4.
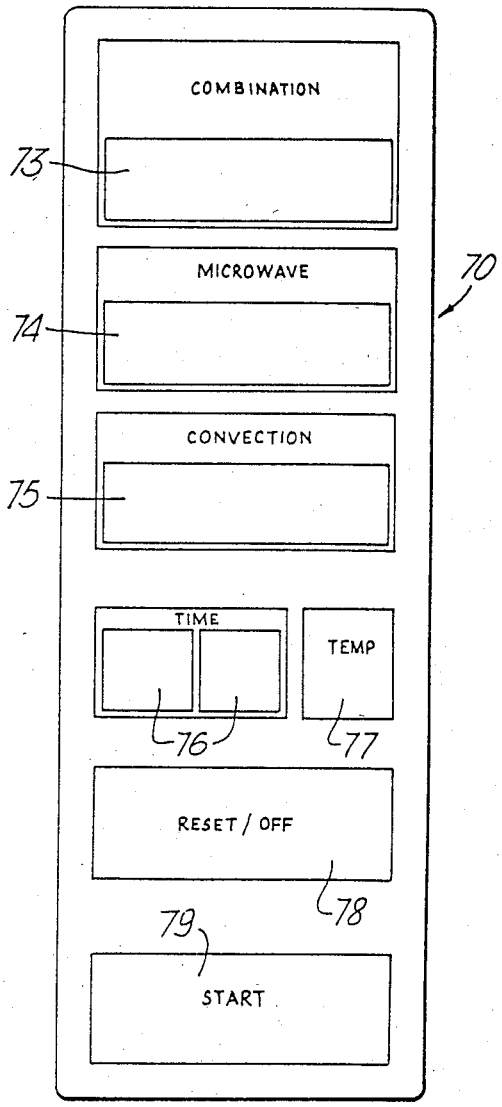

MICROWAVE OVENS AND METHODS OF COOKING FOOD

FIELD OF INVENTION

This invention relates to microwave ovens and to methods of cooking food. The application is a continuation-in-part of U.S. Ser. No. 513,296, filed 7-13-83, now U.S. Pat. No. 4,508,947, 4/2/85.

BACKGROUND OF THE INVENTION

Microwave ovens are capable of cooking, defrosting and reheating food very rapidly but, because the heat energy is generated within the food itself by agitation of the food molecules, the exterior of the food does not reach the temperature required for browning. This disadvantage is met in known microwave ovens by providing some form of thermal heating means in addition to the microwave generator. For example, British Specifications Nos. 1172918 and 1332122 disclose ovens which have thermal heating elements in addition to microwave generators.

Known microwave ovens adopt different ways of using the two forms of energy, i.e. the microwave energy and thermal energy. One known oven produces thermal power only during a first cooking period followed by microwave power only during a second cooking period, the changeover from thermal power to microwave power occurring automatically. During the first period, the thermal power tends to crisp and brown food items without cooking them in the middle. During the second period when microwave energy only is supplied to the oven, steam is generated as a result of the middle of the food becoming heated, and this moisture must find its way result is that the moisture tends to break down the outside of the food layer which absorbs the moisture and becomes soft and unappetizing. To disperse the moisture, the oven is vented during the second period and the temperature drops within the cavity causing deterioration in certain food products, particularly pastry items.

A second known microwave oven operates in the reverse sequence, by having a first cooking period during which microwave energy only is produced followed by a second period during which thermal energy only is produced. During the first period the oven cavity is vented by a forced flow of air to dissipate steam. On commencement of the second period, venting ceases and the thermal power is applied with the object of browning the food item.

Both of these known microwave ovens fail to deal with the problem of dissipating the moisture as it is produced during the period of production of microwave energy. Excess moisture causes condensation on cool oven surfaces as well as making the food soft and pappy. Too much venting to dissipate moisture reduces the temperature of the oven while the application of too much thermal energy tends to burn the outside of the food before the food is cooked in the middle.

The invention aims to provide a microwave oven and a method of cooking food in which the thermal heat input into the oven cavity is sufficient to cope with the moisture driven off the food as the latter is cooked by microwave energy. To achieve this, it has been found that continuous microwave power should be applied simultaneously with continuous thermal power.

Microwave power is produced by a magnetron which must be cooled whilst in operation. This is done by a motor which drives a blower to force cooling air over the magnetron. This flow of air from the blower is put to use in the invention to assist in dissipating moisture or condensation and to cool the oven down after a cooking operation to ensure that each cooking operation commences with the oven in a cold condition.

Microwave ovens are known in which microwave power is applied simultaneously with thermal power. In general, however, such ovens have been large commercial or industrial ovens with high power ratings. This has meant that the power needed for the microwave generator and for the thermal heating elements for any cooking operation has hardly been limited by a power input level to the oven. By contrast, the invention is concerned with portable, plug-in appliances which are designed for domestic use and which can be plugged into a domestic socket having a specified power limit which differs from country to country. The present invention is concerned with providing an oven designed to operate with a maximum power input of 1800 watts (to suit the USA), and an oven designed to operate with a maximum power input of 3000 watts (to suit the UK).

It is known to provide microwave ovens with a fan which causes a flow of hot air (heated by thermal heating means) to pass over the food being cooked. Successful cooking of food in such microwave ovens depends on the correct choice of a number of factors, one of which is the pattern of air flow within the oven cavity. One commercially available oven draws heated air into the cavity from the mid region of the back wall of the cavity, the air being drawn forwardly before splitting up into two streams which are turned to flow backwards along the sides of the oven cavity, before leaving the cavity at two locations in the back wall of the cavity. It has been found that this air flow pattern does not always satisfactorily dissipate moisture generated from the food as it is being cooked by the microwave power. This is a particular problem with pastry items which become soft and pappy if the moisture resulting from the cooking is not dissipated by the hot air stream.

SUMMARY OF THE INVENTION

According to one aspect of the invention a portable microwave oven designed to be powered from a domestic power socket having a standard maximum power rating, comprising a microwave generator for supplying a microwave power to a cavity of the oven, a blower motor for generating a flow of cooling air for said microwave generator, a rotatable turntable on the base of said cavity for supporting food thereon, a port in a wall of said cavity, a shutter movable between an open position in which air is blown through the port and into said cavity by the blower motor and a closed position in which said shutter prevents air delivered by said blower motor from reaching said cavity, thermal heating means capable of heating the air within said oven cavity, and control means operative to supply continuous microwave power to said cavity simultaneously with the supply of thermal power to said cavity, whereby the microwave power heats the inside of the food and the thermal power dissipates the resulting moisture and browns the external surface of the food, said thermal heating means comprising an electrical heating element and fan means for recirculating air over said element and through said cavity, said fan means causing a forced flow of air, heated by said electrical heating element, to enter said cavity from one side thereof, to pass over said turntable and thereafter leave said cavity from the other side thereof, said shutter being in the closed position when said electrical heating element is energised and in the open position to vent the cavity when said electrical heating element is de-energised.

In the preferred embodiment to be described, the oven includes a bypass duct which leads to atmosphere at least some of the air blown over the microwave generator by the blower motor.

When the shutter is in the closed position thereof substantially all the air blown over the microwave generator by the blower motor passes along said bypass duct to atmosphere, and when said shutter is in the open position thereof part of the air blown over the microwave generator is blown through said port and into said cavity and substantially the remainder passes along said bypass duct to atmosphere.

Preferably, the power rating of the oven does not exceed 1620 watts, which allows a margin for US power limits, or does not exceed 2650 or 2700 watts, which allows a margin for UK power limits.

With the lower power oven limited to 1620 watts total input power for the U.S. market, it was found that thermal power of 1250 watts and microwave into the cavity of 200 watts produced good results. Since a typical source of microwave power is about 50% efficient, or slightly better, a power input into the cavity of 200 watts requires a power input to the microwave source of about 360 watts. Preferably, the oven has a single convection or thermal element producing the thermal power. The microwave source (i.e. the magnetron) may be selected to operate at a higher power to deliver more power into the cavity, an interlock ensuring that the magnetron is on low power setting (i.e. 200 watts into the cavity) whenever the thermal element is energized.

With the higher power oven limited to 2650 watts for the UK market, more power is available and there are less constraints. There may be low, medium and high power levels for the magnetron, e.g. corresponding to 200, 300 and 600 watts into the cavity, and the single thermal heating element may have a power rating of about 1450 watts.

BRIEF DESCRIPTION OF THE DRAWINGS

Two microwave ovens according to the invention will now be described, by way of example, with reference to the accompanying drawings, in which:

FIG. 4 shows an alternative control panel for the oven of FIGS. 2 and 3.

DESCRIPTION OF THE PREFERRED EMBODIMENTS

Figure 1:
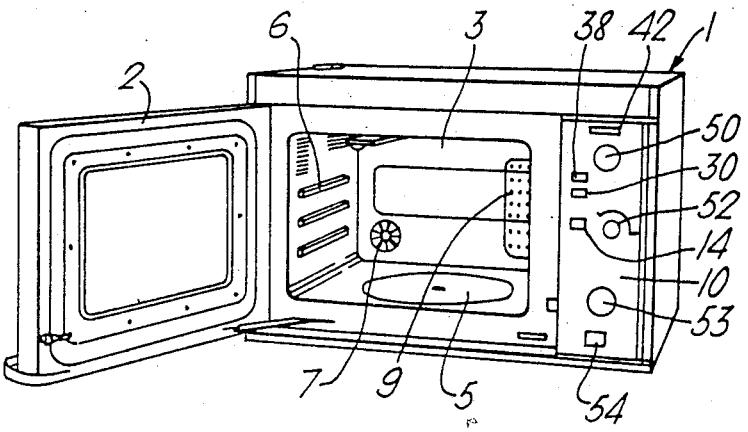
FIG. 1 is a perspective view of the first oven.
Figure 2:
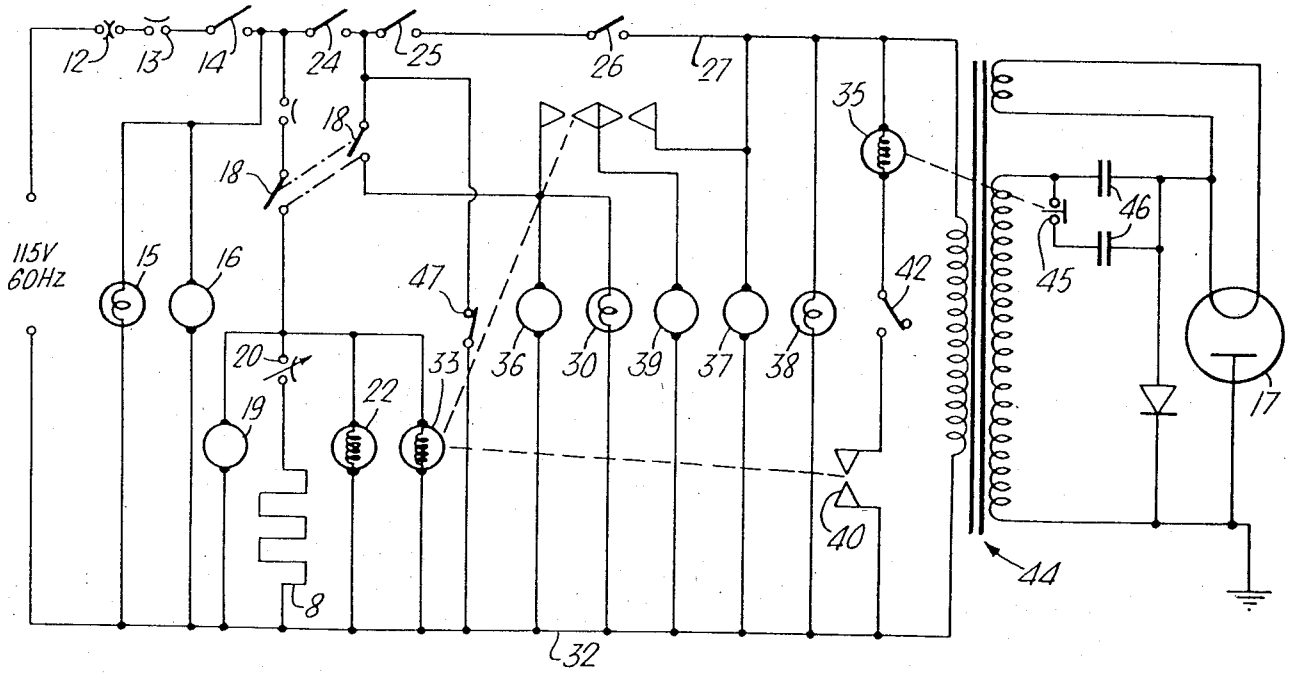
FIG. 2 is an electrical circuit diagram of the circuitry of the first oven.

FIGS. 1 and 2 show an oven designed for use in the USA where domestic appliances should not have a rating more that about 1650 watts. Referring to FIG. 1 the microwave oven has a casing 1 fitted with a hinged door 2 enclosing a cavity 3. The base is fitted with a turntable 5 for rotating the food during cooking. The sides of the cavity 3 have shelf guides 6 and the rear wall of the cavity 3 is provided with a fan 7 for circulating air over a convection element 8 (FIGS. 2 and 5) and through an apertured plate 9.

A control panel 10 has control knobs and dials for the cooker.

FIG. 2 shows the components of the electrical circuit of the oven. Power from a 115 volt, sixty cycle electrical household circuit is led through a 15 amp fuse 12, a magnetron cut-out 13, and an on/off switch 14. When the switch 14 is closed, power at 115 v at 60 Hz is supplied to a cavity lamp 15 and a blower motor 16 for the cooker magnetron 17. A convection timer switch has ganged contacts 18, 18*a*. The contact 18 is connected to a motor 19 for the fan 7, a cavity thermostat 20 in series with the convection element 8 of about 1250 watts, a first relay coil 22, and a second relay coil 33.

A door switch 24, a microwave timer switch 25 and a cook start switch 26 are connected in series in the live power supply line 27 which leads power to the magnetron 17 for supplying microwave power to the cavity. The contacts 18*a* and a convection timer motor 36 are connected across the live and neutral lines 27 and 32. A convection 'on' lamp 30 is connected in parallel across the timer motor 36. A microwave timer motor 37 and a microwave 'on' lamp 38 are connected across the live and neutral lines 27 and 32 in the position shown. A turntable motor 39 for the turntable 5 is connected across a central contact of relay contacts 34 and the neutral line 32. The relay coil 33 controls normally closed relay contacts 40 connected, together with a microwave power change switch 42 and a relay coil 35, across the live and neutral lines 27 and 32. A transformer 44 takes power into the magnetron 17. A switch 45 isolates one of two parallel-connected capacitors 46 so that the magnetron delivers low power. When the relay switch 45 is closed, both capacitors 46 are in circuit and the magnetron 17 delivers high power. On low power the magnetron delivers about 200 watts into the cavity 3, and on high power the magnetron delivers about 650 watts into the cavity 3. Since the magnetron is about 50% efficient, the power taken by the magnetron is about twice that delivered to the cavity, in each of the low and high power settings. For an output power into the cavity of 200 watts, the magnetron requires an input of about 360 watts.

Considering again 1, the control panel 10 has the following controls: the switch 42 for selecting high or low microwave power; a rotary timer 50 which controls the motor 37 and which therefore sets the time up to a maximum of sixty minutes for which the magnetron is operated; the microwave 'on' lamp 38; the convection 'on' lamp 30; the main switch 14; a rotary knob 52 which alters the setting of the thermostat 20 between 50 and 250° C.; a further rotary timer 53 which controls the motor 36 and therefore sets the time up to a maximum of 120 minutes for which the thermal power is produced; and a push-button 54 controlling the switch 26.

The oven is used from a cold start in a 'mixed facility' mode, i.e. with thermal and microwave power, as follows:

(a) the microwave timer 50 is set for the desired cooking time;

(b) the knob 52 is rotated to set the temperature of the thermostat 20;

(c) the convection timer 53 is set for the desired cooking time;

(d) the door 2 is closed to close switch 24 and the cook button 54 is depressed to close the switch 26.

The turntable 5 will revolve and both timers driven by motors 36 and 37 will run simultaneously, causing microwave energy and thermal energy to be produced simultaneously.

So long at the relay coil 33 is energized (which occurs so long as the contact 18 is closed) the contacts 40 are open, which has the effect of ensuring that the magnetron produces low power, regardless of the position of the switch 42.

When the convection timer 53 reaches zero, the switch contacts 18, 18*a* open, which de-energizes the convection heating element 8 and marks the end of the cooking period. Also, the coils 22 and 33 are de-energized. De-energization of the coil 33 causes the contacts 34 to change over. This ensures that the turntable motor can be energized either through the switches 25 and 26 or through the contact 18*a*. The lamp 38 will glow (preferably green) as long as microwave power is being produced, and the lamp 30 will glow (preferably orange) as long as thermal power is being produced. When the microwave timer 50 reaches zero, the switch 25 opens, thereby isolating the magnetron 17. When the oven door 2 is opened, switch 24 opens, thereby cutting off the supply of power to the magnetron. The usual short switch 47 is connected across the lines 27 and 32 to short out the magnetron 17.

The oven of FIGS. 1 and 2 may be operated in a microwave only mode or in a convection only mode, but best results have been achieved in the mixed facility mode described.

Figure 5:
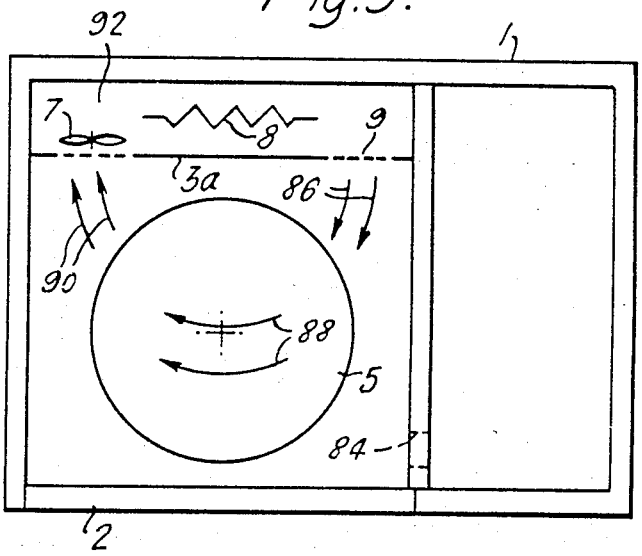
FIG. 5 is a diagrammatic plan view of either embodiment of oven, showing the flow pattern of hot air within the oven.

The relay coil 22 also operates a shutter (or flap) 84 for venting the oven cavity 3 under certain conditions. The shutter 84 is positioned near the top front corner of the right-hand side wall of the cavity 3, as shown in FIG. 5. When convection heat is being supplied to the cavity 3, the relay coil 22 is energized and this closes the shutter 84 to prevent the flow of air delivered by the blower motor 16 from reaching the cavity 3. When convection heat is not being supplied to the cavity 3, the coil 22 is de-energized, thereby opening the shutter 84 and allowing venting of the cavity. During venting, air delivered by the motor 16 is forced into the cavity and thence to atmosphere to remove moisture from the cavity.

Figure 3:
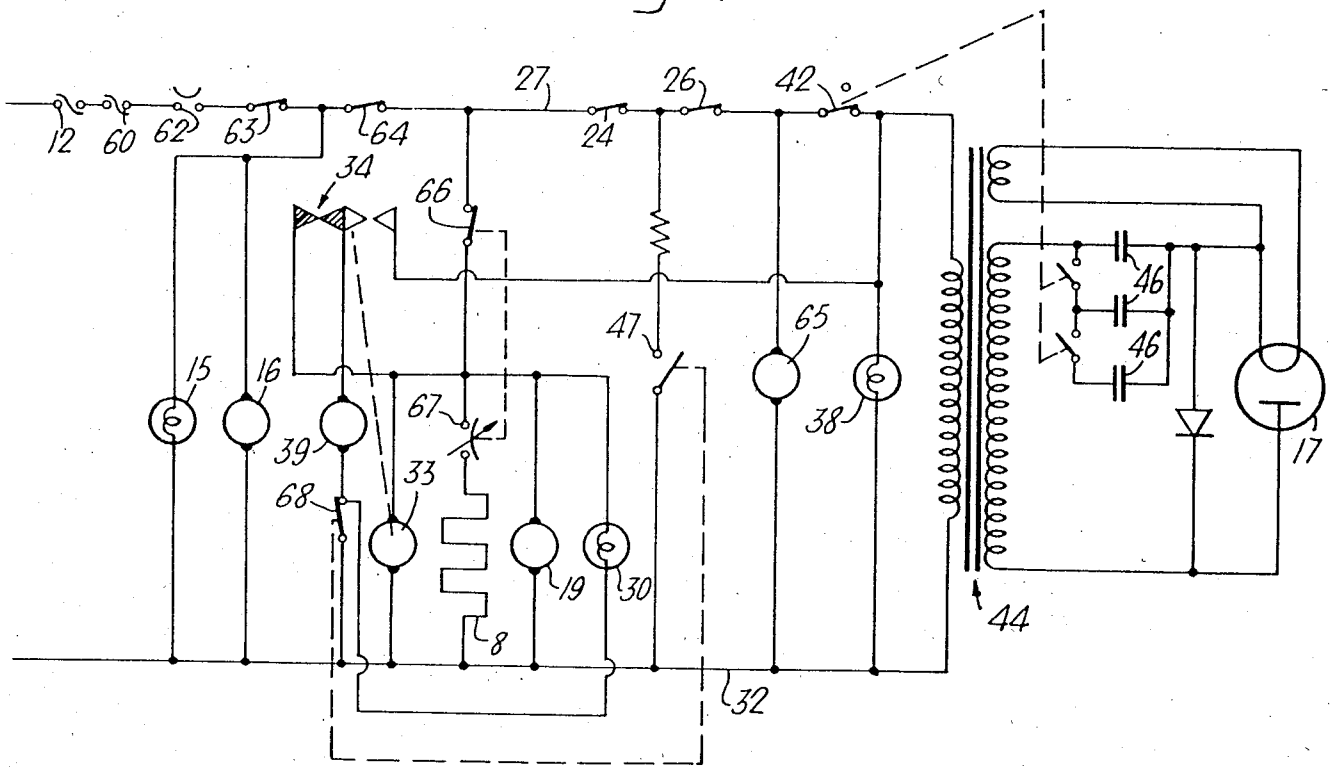
FIG. 3 is an electrical circuit diagram of the circuitry of the second oven.

The oven in FIG. 3 has been designed to suit the UK market, where power up to almost 3 kilowatts may be drawn from a domestic plug/socket.

In FIG. 3, parts corresponding to those of FIG. 2 have been given the same reference numerals. The microwave switch 42 has (in addition to an "off" position) low, medium and high power settings, bringing in one, two or three capacitors 46 respectively, and in any of the three settings the switch 42 closes to conduct power to the transformer 44.

In series with the fuse 12 (rated at 13 amps) is an oven thermostat 60 which cuts out if the cavity temperature rises too high. A magnetron thermostat 62 performs the same function for the magnetron 17. The two switches 63 and 64 are linked to one another, and the switch 64 is linked to a timer motor 65 in the following manner. The switch 63 is an on/off switch corresponding to the switch 14 of FIG. 2, and the switch 64 opens when the timer motor 65 reaches zero, the two switches 63 and 64 being controlled by a single rotary timer knob on the control panel 10.

A convection switch 66 enables the element 8 to be energized independently of the automatic timing facility afforded by the timer motor 65. Thus, in a manual mode, closure of the switch 66 will energize the element 8, causing thermal power to be produced without time limit and without microwave power. For an automatic or timed mode, the cook start switch 26 is closed, and the timer motor set to run from a preset time. When this time has elapsed the switch 64 will open, causing de-energization of the element 8.

When the microwave power is required, the switch 42 is set to the required microwave power level, the timer switch controlling the motor 65 is set to the desired time, and the switch 26 is closed. When the timer motor 65 reaches zero, the switch 64 will open, causing de-energization of the magnetron 17.

The switch 66 is linked to a thermostat switch 67 in the oven cavity, and the monitor switch 47 is mechanically linked to a turntable "off" switch 68.

As for the first embodiment, the oven is normally operated with thermal and microwave power being produced simultaneously, the end of the cooking period being marked by opening of the switch 64 which ceases the production of thermal and microwave power.

The relay coil 33 controls the contacts 34, as in the previous embodiment, and the coil 33 is also used to control the shutter 84. When the coil 33 is de-energized, air supplied by blower motor 16 is directed into the cavity, but when the coil 33 is energized the shutter 84 closes an air entrance port to the cavity, directing the air to atmosphere.

The invention enables a microwave oven to operate very effectively on a maximum power intake suitable for US or UK requirements. The simultaneous delivery of thermal and microwave power enables the moisture to be dissipated by the thermal power as the moisture is produced from the inside of the food being cooked by microwave power. This has been found to be particularly advantageous for pastry items, which are particularly sensitive to any excess of moisture during cooking.

Instead of the described control panel 10, the oven of FIG. 2 or 3 may be equipped with the panel 70 shown in FIG. 4. The panel 70 has touch-sensitive pads, and a display 72. The pads comprise a COMBINATION pad 73, a MICROWAVE pad 74, a CONVECTION pad 75, two TIME pads 76, a TEMP pad 77, a RESET/-OFF pad 78 and a START pad 79. The panel 70 is operated as follows in three possible modes:

(1) Combination cooking mode (i.e., microwave and thermal power)

Touch COMBINATION pad 73—once for low microwave power twice for medium low microwave power (FIG. 3 only) three times for high microwave power (FIG. 3 only);

Touch TEMP pad 77 until desired temperature is reached, as indicated by figures 80 illuminated in display 72;
Touch TIME pad(s) 76 until desired time is reached as indicated by figures 82 in display 72;
Touch START pad 79.

During cooking, the display 72 shows the cooking time counting down, the temperature selected and the COMB mode. For the UK model of FIG. 3, it will also show which level of combination.

(2) Microwave only cooking mode

Touch MICROWAVE pad 74—once for high power twice for medium low three times for low power;
Touch TIME pad(s) 76 until desired time is reached;
Touch START pad 79.

During cooking, the display 72 shows the cooking time counting down, MW mode and microwave power level.

(3) Convection only cooking mode

Touch CONVECTION pad 75;
Touch TEMP pad 77 until desired temperature is reached;
Touch TIME pad(s) 76 until desired time is reached;
Touch START pad 79.

If preheat is required, the oven is set up as described and heated for a period of time or until the temperature is reached.

To indicate that the temperature is reached, the temperature indicator on the display could flash;

During cooking, the display 72 shows the cooking time counting down, the temperature selected on CONV mode.

At the end of the cooking time, a continuous beep will sound and the heat will be automatically switched off.

To switch off bleep sound, touch pad 78 and time of day will be displayed. The pad 78 may alternatively be a depressible switch.

The pad 70 may be linked to a microprocessor providing the necessary control functions to the thermal heating elements, the microwave generator and other operative components of the oven.

The apertured plate 9 is positioned at the right-hand side of the rear wall 3*a* and is vertically elongated so as to allow hot air to enter the cavity 3 over a substantial height thereof. The fan 7 is positioned at the left-hand side of the rear wall 3*a*, near the lower corner, and is electrically driven to force a flow of hot air to pass over the food while the latter is supported on the rotary turntable 5.

FIG. 5 shows the air flow pattern within the oven. Hot air passing through the apertured plate 9 enters the cavity 3 (arrows 86), passes over the turntable 5 (arrows 88) and is drawn through the fan 7 (arrows 90) into a a compartment 92 at the rear of the cavity 3. Within the compartment 92 is arranged the thermal heating element 8 (shown diagrammatically in FIG. 5) which heats the air before the latter enters or re-enters the cavity 3. The turntable 5 rotates counter-clockwise as shown in FIG. 5 to maximize the relative velocity between the hot air entering the cavity through the aperture plate 9 and the food rotating on the turntable 5.

The described air flow pattern is efficient in heating the food, but leaves the walls of the oven cavity cool in comparison with known air flow patterns where hot air is blown alongside the cavity walls.

Above the fan 7, the rear wall 3*a* has vent holes (not shown) for venting of moisture to the oven surroundings.

Figure 6:
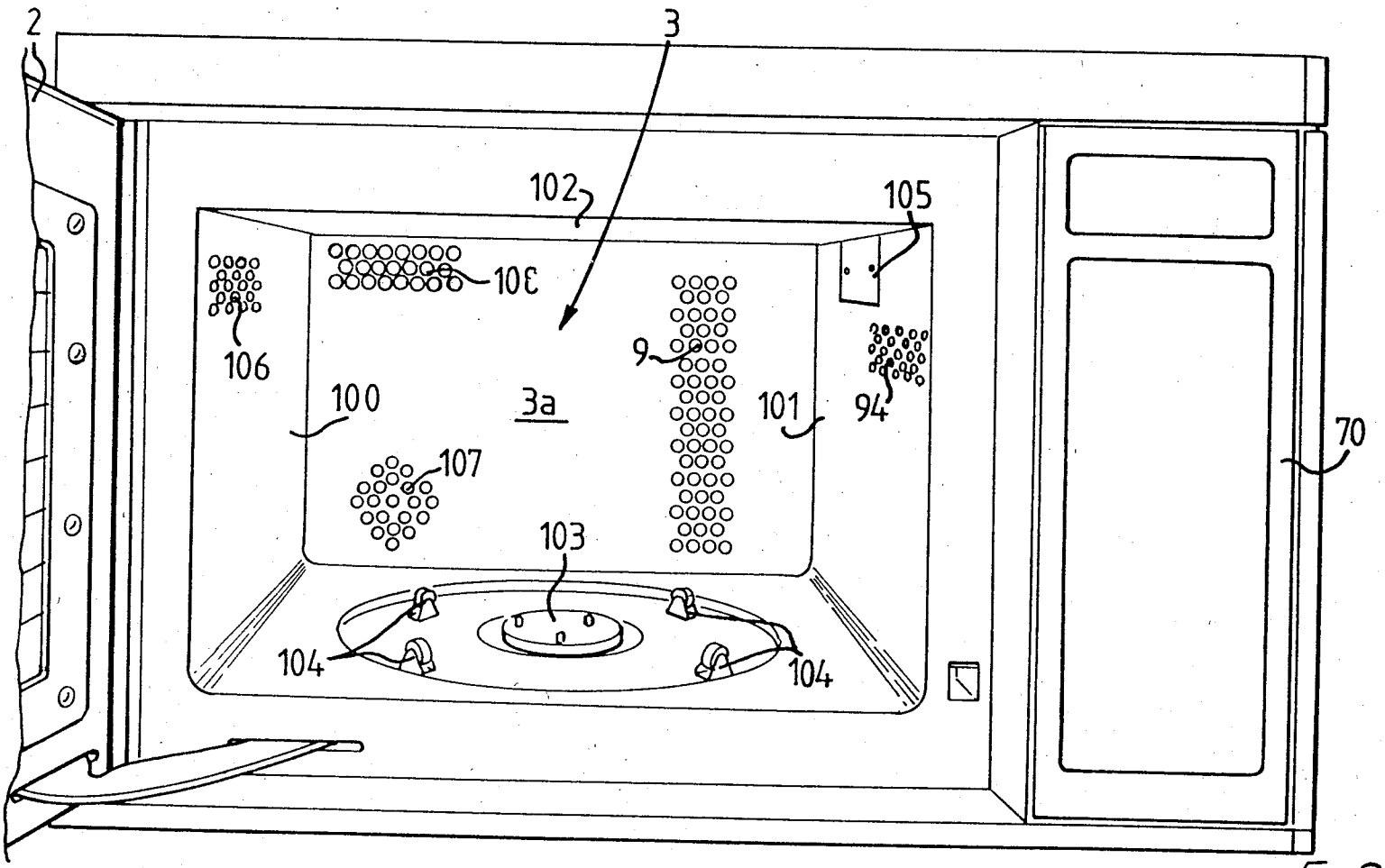
FIG. 6 is a perspective view of the oven with a door open to reveal the oven cavity.
Figure 8:
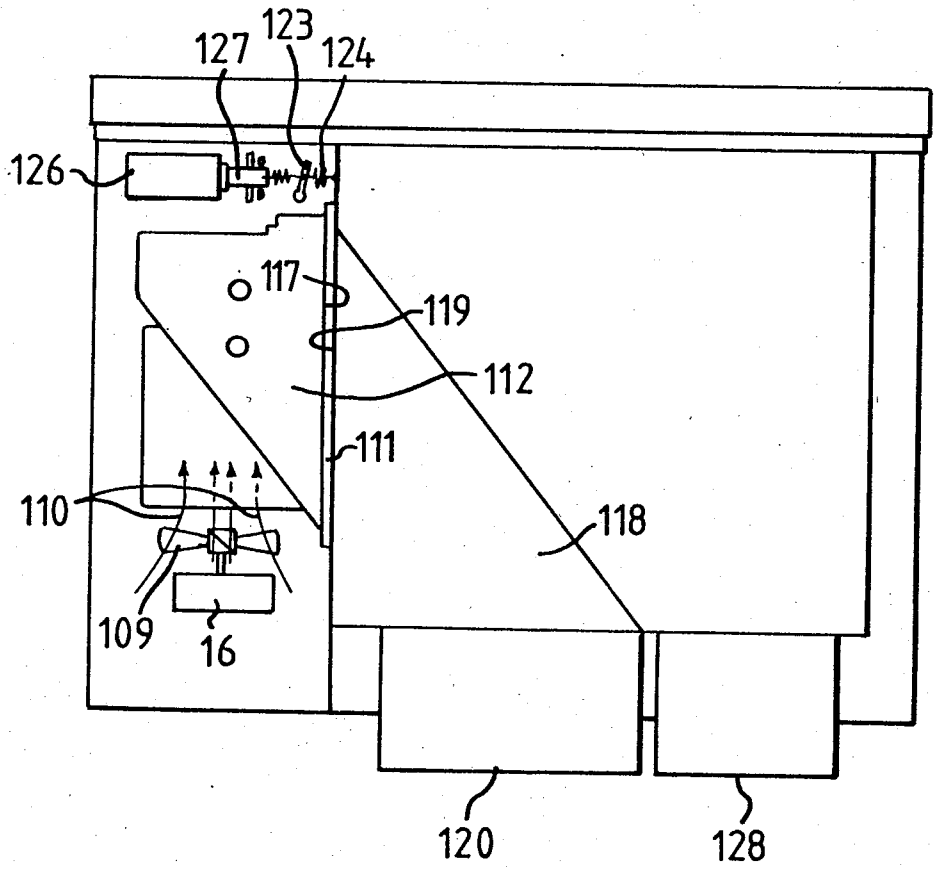

It will be seen from the circuit diagrams of FIGS. 2 and 3 that if the door is opened during cooking, resulting in opening of the switch 24, the magnetron is de-energized but power continues to the heating element 8. FIGS. 6 and 8 show the structure of both embodiments of oven previously described, and in particular these figures show the structure and operation of the shutter 84 and the way in which the air from the blower motor 16 is used to vent the cavity and to dissipate moisture which would otherwise form at the rear of the oven.

Referring to FIG. 6, the cavity 3 has two side walls 100, 101 and a top wall 102. The base of the cavity has a central drive 103 for rotating the turntable (not shown), the underside of which is supported by four rollers 104. Reference 94 indicates the air entrance port which is disposed in the side wall 101 and which is controlled by the movable shutter 84. Microwave energy is launched into the cavity 3 through a panel 105 in the side wall 101.

No shelf guides are provided as it is intended that all food items will be supported and rotated on the turntable. The control panel 70 may be as shown in FIG. 4. The side wall 100 has an apertured area 106 blanked off by a glass panel through which the cavity lamp 16 shines when illuminated. The rear wall 3*a* of the cavity has, at a location above the air outlet 107 to the fan 7, a series of vent holes 108 for the exit of moisture from the cavity.

Figure 7:
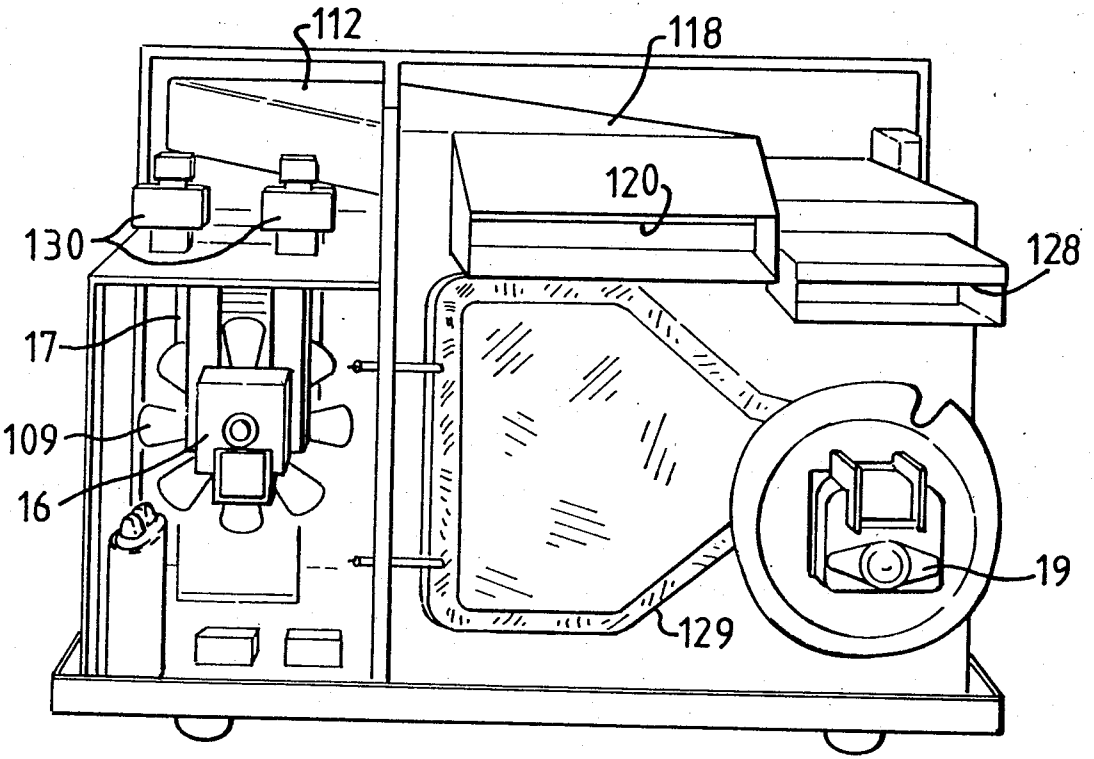
FIG. 7 is a rear view of the oven with a rear panel removed.

As can be appreciated from FIGS. 7 and 8, the magnetron 17 and the blower motor 16 are located behind the control panel 70, between the side wall 101 and an outer casing (not shown) of the oven. The blower motor 16 drives a blower 109 which has rotatable blading acting to force a flow of cooling air over the magnetron 17. This flow of cooling air is indicated by arrows 110 in FIG. 8.

Figure 9:
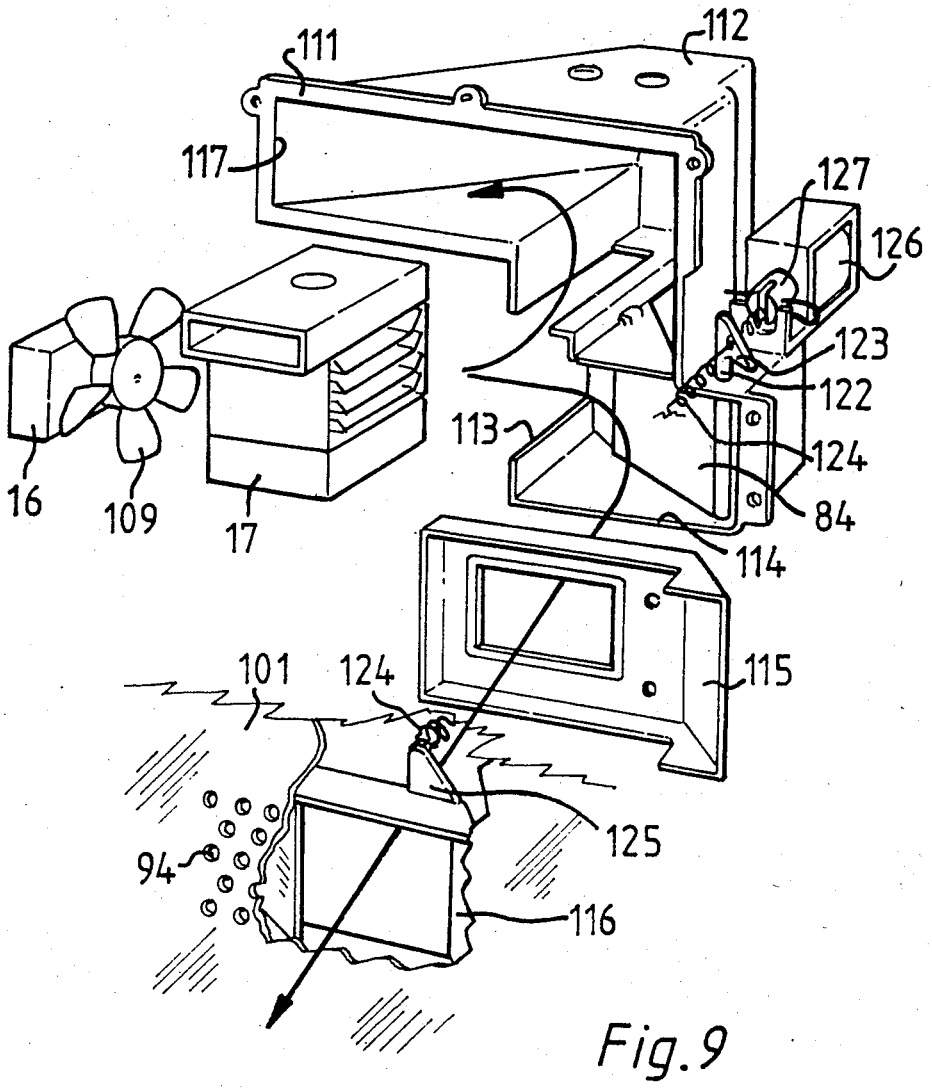
FIG. 9 is a perspective view, with parts exploded, showing the air flow pattern when a shutter of the oven is open.
Figure 10:
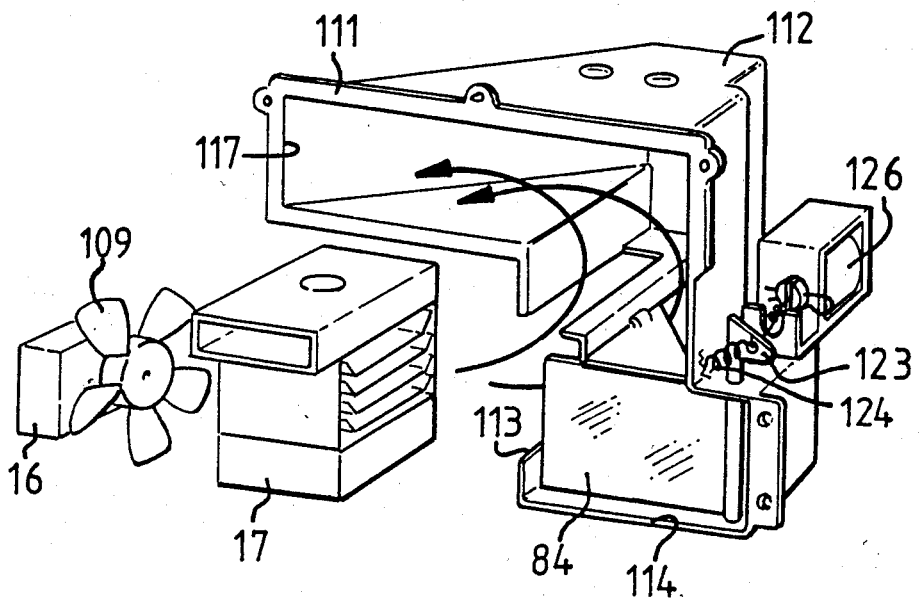
FIG. 10 is a view similar to that of FIG. 5 but showing the air flow pattern when the shutter is closed.
Figure 11:
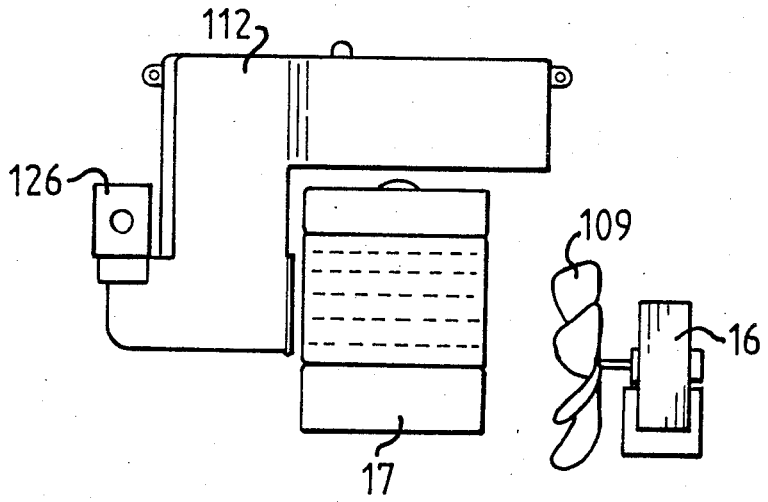
FIG. 11 is a fragmentary, side view of the oven looking in the direction of arrow XI—XI in FIG. 8.

As best seen in FIGS. 8, 9 and 10, attached to the exterior of the side wall 101 is a plastics housing 112 which has an edge flange 111 by which the housing 112 is attached to the exterior of the side wall 101. The housing 112 has an inlet 113 positioned adjacent the magnetron 17 so as to receive the flow of air forced over the magnetron 17 by the blower 109. The housing 112 also has two outlets for this air: a first outlet 114 registers, through the intermediary of a shaped flexible seal 115, with an apertured member 116 directing the air to the air entrance port 94 in the side wall 101; a second outlet 117 registers with an inlet 119 of a bypass duct 118. The bypass duct 118 extends from its inlet 119 above the side wall 101, over the top wall 102 to a rear outlet 120 (FIGS. 7 and 8).

The housing 112 provides a pivotal mounting for the shutter 84 which is shown in its normally open position in FIG. 9 and in its closed position in FIG. 10. The shutter 84 has upper and lower bearing pivots by which the shutter is pivotally mounted in the housing 112 about a vertical pivot axis, and the upper bearing pivot 122 is extended upwardly to form a lever 123 which provides an anchorage for one end of a helical tension spring 124 the other end of which is attached to a lug 125 on the apertured member 116 fixed in the side wall 101. The spring 124 urges the shutter 84 to the open position shown in FIG. 9 in which the air blown into the housing 112 by the blower motor 16 passes through the port 94 and thence into the cavity 3. A further flow of air passes through the second outlet 117 and thence into the bypass duct 118. This division of the airflow is shown by the arrows marked in FIG. 9.

A solenoid 126 mounted on the housing 112 has its movable core 127 connected to the lever 123, so that energisation of the relay coil 22 energises the solenoid 126 and causes the shutter 84 to move to its closed position shown in FIG. 10. When the shutter 84 is in its closed position, the shutter 84 abuts the seal 115 and therefore closes the port 94, and in consequence air from the blower 109 is prevented from entering the cavity 3, substantially all the air leaving the housing 112 through the outlet 117 and passing along the bypass duct 118.

The rear outlet 120 of the bypass duct 118 is best seen in FIG. 7. The outlet 120 is positioned beside a further ducted outlet 128 which surrounds the vent holes 108 in the rear wall 3*a*. Hence, moisture venting from the cavity through the holes 108 issues from the outlet 128 at the rear of the oven. FIG. 7 also shows the rear of the motor 19 and the shaped housing 129 enclosing the electrical resistance heating element 8. Two contactors 130 controlling the capacitors for the magnetron are also shown in FIG. 7.

Figure 12:
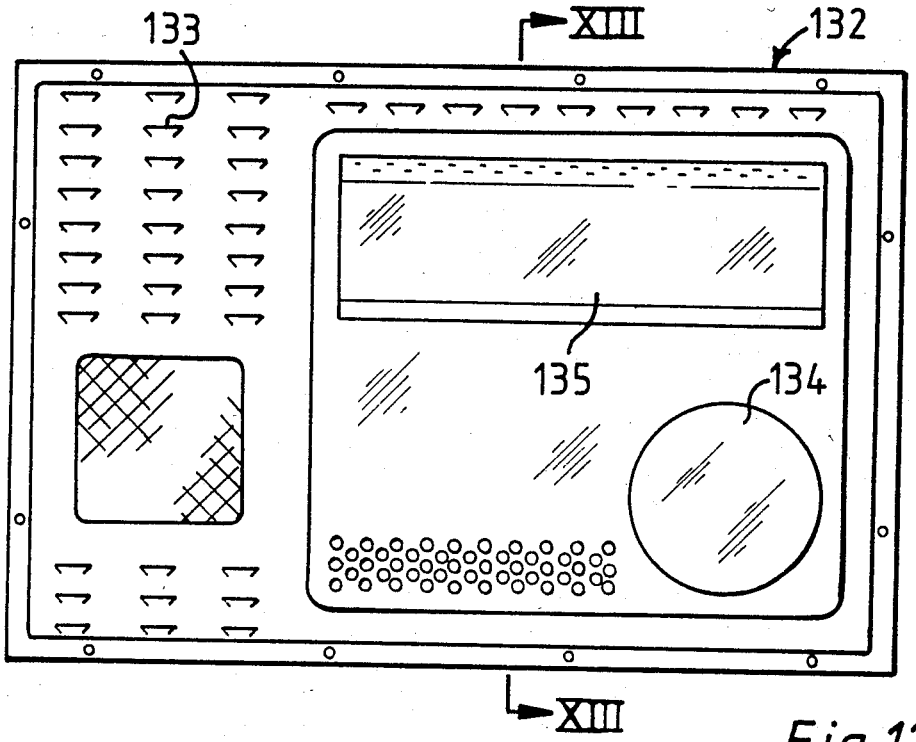
FIG. 12 is a view of the rear panel of the oven.
Figure 13:
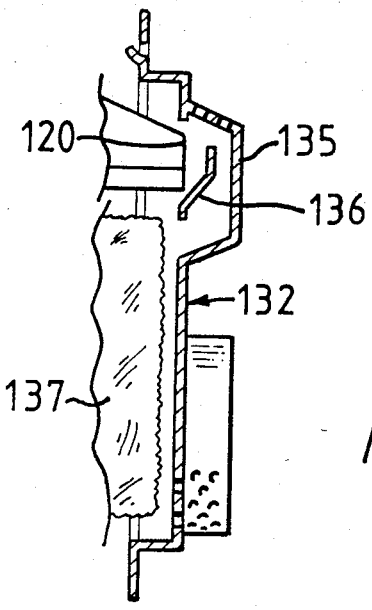
FIG. 13 is a fragmentary sectional view on line XIII—XIII of FIG. 2.

The rear of the oven is closed by a rear panel 132 shown in FIGS. 12 and 13. The panel 132 has ventilating louvres 133, a rearwardly projecting circular housing portion 134 acccommodating the rear of the motor 19 and a rearwardly projecting portion 135 enclosing the outlets 120 and 128. Within the portion 135, the rear panel 132 has a baffle plate 136 which lies immediately rearwardly of the outlets 120 and 128 and acts to deflect upwardly the air and moisture respectively issuing from the outlets 120 and 128. Part of the thermal insulation at the rear of the element 8 is also visible at 137 in FIG. 13.

As soon as the oven is switched on by closure of the switch 14, the blower motor 16 is energised and air is blown over the magnetron 17, even though the latter may not have been energised. The air enters the housing 112, part of the air passing through the port 94 and into the cavity 3 (since the shutter 84 is open), the remainder of the air passing along the bypass duct 118. This is an idling condition of the oven. If microwave only power is selected, the air flow regime remains the same as in the idling condition, ie as shown in FIG. 9, except that the air will be warmed as a result of passing over the energised magnetron 17. The air entering the cavity 3 vents the latter by entraining moisture which leaves the cavity through the vent holes 108. The moisture passes out of the outlet 128 and any tendency for the moisture to condense on the rear panel 132 is prevented by the flow of warm air issuing from the adjacent outlet 120 of the bypass duct 118.

If the convection element is energised, either alone or with the magnetron, the solenoid 126 is energised and in consequence the shutter 84 is closed. As a result, all the air delivered by the blower motor 16 is directed through the bypass duct 118 as illustrated by the arrows in FIG. 10. After a cooking operation has finished, the oven reverts to the idling condition, and the air blown through the cavity 3 vents and cools the latter so that a subsequent cooking operation commences with the oven in a cool condition. This is important for consistent repeatable cooking results.

I claim:

1. A portable microwave oven designed to be powered from a domestic power socket having a standard maximum power rating comprising two side walls, a base, a top wall, a rear wall and a closable front door together defining an oven cavity, a magnetron for supplying microwave power to the said cavity, a blower motor for generating a flow of cooling air for said magnetron, a rotatable turntable on the base of said cavity for supporting food thereon, a port in one of said side walls of said cavity, a vent in the rear wall, a shutter movable between an open position in which air is blown through the port and into said cavity by the blower motor and a closed position in which said shutter prevents air delivered by said blower motor from reaching said cavity, a by-pass duct extending from an inlet adjacent the magnetron to an outlet at the rear of the oven, thermal heating means capable of heating the air within said oven cavity, and control means operative to supply continuous microwave power to said cavity simultaneously with the supply of thermal power to said cavity so that the microwave power heats the inside of the food while the thermal power dissipates the resulting moisture and browns the external surface of the food, said thermal heating means comprising an electrical heating element and fan means for recirculating air over said element and through said cavity, said fan means causing a forced flow of air heated by said electrical heating element to enter said cavity from one side thereof, to pass over said turntable and thereafter leave said cavity from the other side thereof, said shutter being in the closed position thereof when said electrical heating element is energized so that air blown over the magnetron by the blower motor passes along the by-pass duct to atmosphere, and said shutter being in the open position thereof to vent the cavity when said electrical heating element is de-energized so that air blown over the magnetron by the blower motor divides into two paths one of which passes through the port of the cavity and thence through the vent to atmosphere and the other of which passes along the by-pass duct to atmosphere.

2. A microwave oven according to claim 1, wherein said vent has vent holes leading to a vent outlet disposed adjacent the outlet of said by-pass duct so that air issuing from said by-pass duct disperses moisture or condensation in the region of said vent outlet.

3. A microwave oven according to claim 2, wherein said vent holes are disposed above an outlet through which said recirculating air is drawn from said cavity by said fan means.

4. A microwave oven according to claim 2, comprising a back panel of the oven which encloses said region into which said vent outlet and said by-pass introduce air and moisture, said panel being shaped to direct air and moisture upwardly away from said region to the atmosphere.

5. A microwave oven according to claim 1, comprising spring means that urge said shutter to the open position thereof, actuating means being provided to move said shutter to the closed position thereof when said electrical heating element is energized.

6. A microwave oven according to claim 5, wherein said actuating means comprises an electromagnetic solenoid which is energized when the electrical heating element is energized.

7. A microwave oven according to claim 1, wherein said blower motor is energized whenever the oven is switched on so that an idling mode, before or after cooking, air is blown by said blower motor over said microwave generator, through the open said port and into said cavity to vent the latter sufficiently to ensure that cooking commences with said cavity in a substantially cool condition.

8. A microwave oven according to claim 1, comprising a housing attached to said one side wall of said cavity on the external side thereof, said housing having an inlet adjacent said magnetron to receive air blown thereover by said blower motor, a first outlet which is closable by said shutter and which registers with said port and a second outlet which registers with said bypass duct leading over the top of said top wall.

9. A microwave oven according to claim 8 wherein said housing is molded from a plastic material and has said shutter pivotally mounted therein.

10. A portable microwave oven designed to be powered from a domestic power socket having a standard maximum power rating comprising two side walls, a base, a top wall, a rear wall and a closable front door together defining an oven cavity, a magnetron for supplying microwave power to said cavity of the oven, a blower motor for generating a flow of cooling air for said magnetron, a rotatable turntable on the base of said cavity for supporting food thereon, a port in one of said side walls of said cavity, a vent in the rear wall, said vent leading to a vent outlet at the rear of the oven, a shutter mounted adjacent the port and movable between an open position in which said port is open and air is blown through said port and into said cavity by said blower motor and a closed position in which said port is closed by said shutter which prevents air delivered by said motor blower from reaching said cavity, thermal heating means capable of heating the air within said oven cavity, and control means operative to supply continuous microwave power to said cavity simultaneously with the supply of thermal power to said cavity, so that the microwave power heats the inside of the food while the thermal power dissipates resulting moisture and browns the external surface of the food, said thermal heating means comprising an electrical heating element and fan means for recirculating air over said element and through said cavity, said fan means causing a forced flow of air heated by said electrical heating element to enter said cavity from one side thereof, to pass over said turntable and therefter leave said cavity from the other side thereof, said shutter being in the closed position when said electrical heating element is energized and in the open position to vent the cavity when said electrical heating element is de-energized so long as the oven is switched on, said blower motor being energized and means being provided to direct at least some of the air delivered by said blower motor to a region adjacent said vent outlet to prevent condensation in said region.

* * * * *